US009217953B2

(12) United States Patent
Sakaya

(10) Patent No.: US 9,217,953 B2
(45) Date of Patent: Dec. 22, 2015

(54) DEVELOPING DEVICE, AND IMAGE FORMING APPARATUS AND PROCESS UNIT INCORPORATING SAME

(71) Applicant: Kohta Sakaya, Hyogo (JP)

(72) Inventor: Kohta Sakaya, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/303,924

(22) Filed: Jun. 13, 2014

(65) Prior Publication Data

US 2015/0003848 A1 Jan. 1, 2015

(30) Foreign Application Priority Data

Jun. 26, 2013 (JP) ..... 2013-133814

(51) Int. Cl.
*G03G 15/08* (2006.01)
*G03G 21/18* (2006.01)

(52) U.S. Cl.
CPC ..... *G03G 15/0831* (2013.01); *G03G 15/0893* (2013.01); *G03G 21/18* (2013.01)

(58) Field of Classification Search
CPC . G03G 1/00; G03G 15/2075; G03G 15/2078; G03G 15/6573; G03G 15/2014; G03G 2215/00383; G03G 15/0178; G03G 15/2039; G03G 15/2053; G03G 15/2064; G03G 15/5004; G03G 15/5029; G03G 15/5062
See application file for complete search history.

(56) References Cited

U.S. PATENT DOCUMENTS

| | | | | |
|---|---|---|---|---|
| 2003/0118355 | A1* | 6/2003 | Guy et al. | 399/12 |
| 2005/0281589 | A1* | 12/2005 | Sakai et al. | 399/254 |
| 2010/0104305 | A1* | 4/2010 | Morimoto | 399/58 |
| 2011/0188896 | A1 | 8/2011 | Sakaya et al. | |
| 2011/0194864 | A1 | 8/2011 | Nakatake et al. | |
| 2011/0217055 | A1 | 9/2011 | Takehara et al. | |
| 2012/0189327 | A1 | 7/2012 | Kubota et al. | |

FOREIGN PATENT DOCUMENTS

| | | |
|---|---|---|
| JP | 2001-114193 | 4/2001 |
| JP | 2006-343494 | 12/2006 |
| JP | 2007-140291 | 6/2007 |
| JP | 2011-059239 | 3/2011 |
| JP | 2012-155141 | 8/2012 |

* cited by examiner

*Primary Examiner* — Roy Y Yi
(74) *Attorney, Agent, or Firm* — Oblon, McClelland, Maier & Neustadt, L.L.P

(57) ABSTRACT

A developing device includes a developer container, a developer bearer, a partition to divide an interior of the developer container into a first compartment to which developer is supplied and a second compartment in which the developer bearer is disposed, main communication openings provided at both ends of the partition, a sub-communication opening provided in an intermediate portion of the partition, developer conveyance members provided in the first compartment and the second compartment to circulate developer between the first compartment and the second compartment, and a developer amount detector to detect an amount of developer in a detection area positioned in the first compartment and adjacent to the sub-communication opening.

20 Claims, 10 Drawing Sheets

DEVELOPING DEVICE, AND IMAGE FORMING APPARATUS AND PROCESS UNIT INCORPORATING SAME

CROSS-REFERENCE TO RELATED APPLICATIONS

This patent application is based on and claims priority pursuant to 35 U.S.C. §119(a) to Japanese Patent Application No. 2013-133814, filed on Jun. 26, 2013, in the Japan Patent Office, the entire disclosure of which is hereby incorporated by reference herein.

BACKGROUND

1. Technical Field

Embodiments of the present invention generally relate to a developing device; and a process unit and an image forming apparatus, such as a copier, a printer, a facsimile machine, or a multifunction machine including at least two of these functions, that include a developing device.

2. Description of the Related Art

In general, electrophotographic image forming apparatuses such as copiers, printers, facsimile machines, or multifunction machines including at least two of these functions include a developing device to develop latent images formed on an image bearer with developer, and a toner container (i.e., a toner cartridge) for containing developer such as toner. As the toner in the development device is consumed in image development, fresh toner is supplied from the toner container to the developing device. If mixing of the toner supplied from the toner container and the toner existing in the developing device is insufficient, the ratio of supplied toner becomes uneven between a portion adjacent to a toner supply inlet formed in the developing device and other portions inside the developing device. In such a state, it is possible that image density becomes uneven or toner scatters on the backgrounds of output images.

Therefore, toner is circulated inside the developing device to equalize the state of toner (the ratio of the supplied toner) inside the developing device. For example, an interior of the development housing (or a casing) is divided with a partition into first and second compartments that communicate with each other in both axial end portions, and conveyance members such as conveyance screws are provided in the first compartment and the second compartment, respectively, to transport the toner therein. Toner is supplied from the toner cartridge to the first compartment, and a developing roller is provided in the second compartment. The conveyance screws transport the toner in the respective compartments in the opposite directions, and the toner transported to an end portion in one compartment is transported through a communication opening at the end of the partition to the other compartment. Then, toner is transported by the conveyance screw to the opposite end portion, after which the toner moves through the communication opening again to the other compartment. Toner can be circulated between the first compartment and the second compartment by repeating this operation. Accordingly, the supplied toner can be mixed with the toner existing in the developing device, and the ratio of supplied toner can become uniform.

Even in developing devices in which developer is thus circulated, it is possible that the amount of toner therein decreases to a degree that image density becomes insufficient if toner is not timely supplied to the developing device.

For example, JP-2012-155141-A proposes, for controlling the timing of toner supply, providing an optical sensor, as a developer amount detector, to the first compartment to which toner is supplied and detecting the amount of toner remaining therein according to changes in the amount of light in a detection area thereof.

SUMMARY

In view of the foregoing, an embodiment of the present invention provides a developing device that includes a developer container to contain developer; a developer bearer to bear developer on a surface thereof; a partition to divide an interior of the developer container into a first compartment to which developer is supplied and a second compartment in which the developer bearer is disposed; developer conveyance members provided in the first compartment and the second compartment to circulate developer between the first compartment and the second compartment; and a developer amount detector to detect an amount of developer in a detection area positioned in the first compartment. Main communication openings are provided at both ends of the partition so that the first compartment and the second compartment communicate with each other through the main communication openings. Further, a sub-communication opening is provided in an intermediate portion of the partition so that the first compartment and the second compartment communicate with each other through the sub-communication opening, and the detection area in the first compartment is adjacent to the sub-communication opening.

In another embodiment, a process unit removably installable in an image forming apparatus includes an image bearer on which an image is formed; and the above-described developing device.

In yet another embodiment, an image forming apparatus includes the above-described process unit.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
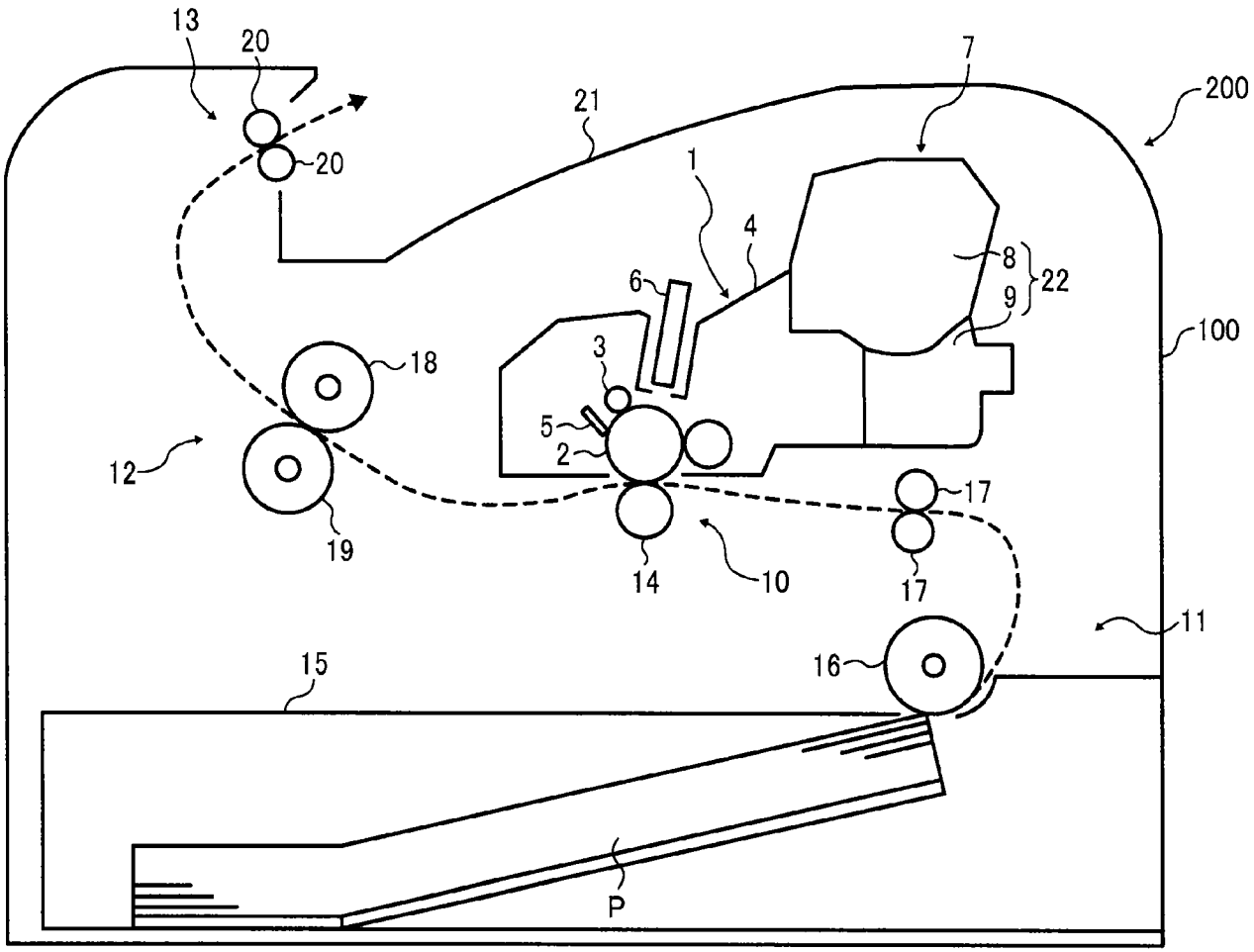
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In developing devices in which toner is transported by rotating a conveyance screw inside a housing of the developing device, the force of the conveyance screw to transport toner is hardly exerted outside an orbit of rotation of the conveying screw (in gaps between the outer circumference of a screw blade of the conveyance screw and an inner wall of the housing) although toner moves slightly following the movement of toner inside the orbit of rotation of the conveyance screw. Thus, toner is likely to aggregate (so-called state of bridges) and accumulate. In an arrangement in which the detection area of a developer amount detector, such as an optical sensor, is outside the orbit of rotation of the conveyance screw, the amount of toner in the detection area is less likely to change. In this case, it is possible that the developer amount detector erroneously detects that the amount of toner is sufficient although the amount of toner in the housing as a whole is below a predetermined amount.

Inside the orbit of rotation of the conveyance screw to transport toner inside the developing device, the force to transport toner is exerted, and toner can be loosened. To use this effect, the detection area of the developer amount detector may be disposed inside the orbit of rotation of the conveyance screw.

The inventor of the present invention, however, recognizes that there still be the possibility of erroneous detection of the amount of toner remaining in the developing device in this arrangement.

For example, to secure the detection area of the developer amount detector inside the orbit of rotation of the conveyance screw, the screw blade is absent in a partial range in an axial direction of the conveyance screw. In the partial range where the screw blade is absent, however, the force to transport toner is weaker, and there is a risk of aggregation and retention of toner outside the orbit of rotation in that range. Accordingly, in the arrangement in which the detection area of the developer amount detector is inside the orbit of rotation of the conveyance screw, it is possible that the amount of toner flowing from outside the orbit of rotation into the detection area is extremely small, and the developer amount detector erroneously detects that the amount of toner is sufficient although the amount of toner in the housing as a whole is below a predetermined amount.

Additionally, the housing of the developing device is reduced in size due to a current trend of compact image forming apparatuses. It makes difficult to reliably circulate toner inside the housing. Consequently, it is possible that the amount of toner can defer between the first compartment and the second compartment, and the amount of toner in the second compartment is not known correctly based on the detection area in the first compartment, resulting in erroneous detection of the amount of toner.

Although a conceivable approach is to dispose the detection area in the second compartment, such an arrangement is not desirable since components of the detector disposed in the second compartment may hinder the flow of toner close to the developing roller and thus adversely affect image quality.

If toner is supplied according to the erroneous detection, the amount of toner inside the developing device can become extremely large or small. If the amount of toner therein is extremely large, the pressure of toner (i.e., powder pressure), increases, and the possibility of leak of toner from the developing device increases. If the amount of toner therein is extremely small, output images tend to fade. In either case, there are risks of image quality degradation and damage to the device.

It is to be noted that, the inconveniences described above can arise in configurations employing two-component developer including toner and carrier as well as configurations employing one-component developer consisting essentially of toner.

According to the embodiment described below, even when developer aggregates and remains adjacent to the detection area in the first compartment, the remaining developer is moved by developer flowing from the second compartment through a sub-communication opening to the detection area in the first compartment. The sub-communication opening to cause such flow of developer is disposed in an intermediate portion of the partition.

Accordingly, with the effects of developer flowing through the sub-communication opening, the amount of developer in the detection area in the first compartment can be kept to a desirable level reflecting the amount of developer adjacent to the developer bearer and inside the second compartment. Accordingly, erroneous detection of the amount of developer can be reduced, and accuracy of the detection can improve.

Referring now to the drawings, wherein like reference numerals designate identical or corresponding parts throughout the several views thereof, and particularly to FIG. 1, an image forming apparatus according to an embodiment of the present invention is described.

FIG. 1 is a schematic view of an image forming apparatus 200 according to the present embodiment.

Referring to FIG. 1, a configuration and operation of the image forming apparatus 200 is described below.

The image forming apparatus 200 shown in FIG. 1 is a monochrome image forming apparatus, for example. A process unit 1 serving as an image forming unit is removably installed in an apparatus body 100 that is a body of the image forming apparatus 200. The process unit 1 includes a photoreceptor 2 serving as an image bearer on which images are formed, a charging roller 3 serving as a charging member to charge the surface of the photoreceptor 2, a developing device 4 to develop a latent image on the photoreceptor 2, and a cleaning blade 5 serving as a cleaning device to clean the surface of the photoreceptor 2. Additionally, a light-emitting diode (LED) head array 6 serving as an exposure device to expose the surface of the photoreceptor 2 is provided at a position facing the photoreceptor 2.

Additionally, a toner cartridge 7 serving as a developer container is removably attached to the process unit 1. In the present embodiment, the toner cartridge 7 includes a toner chamber 8 to contain toner supplied to the developing device 4 and a waste-toner chamber 9 in which toner removed by the cleaning blade 5 is collected. The toner chamber 8 and the waste-toner chamber 9 are united together in a container body 22 of the toner cartridge 7.

The image forming apparatus 200 further includes a sheet feeder 11, a transfer device 10 to transfer images onto sheets of recording media fed by the sheet feeder 11, a fixing device 12 to fix images on the sheets, and a discharge device 13 to discharge the sheets outside the image forming apparatus 200.

The transfer device 10 includes a transfer roller 14 serving as a transfer member. The transfer roller 14 is in contact with the photoreceptor 2 in a state in which the process unit 1 is installed in the apparatus body 100, and the contact portion therebetween is called a transfer nip. Additionally, the transfer roller 14 is electrically connected to a power source and receives a predetermined amount of voltage that is either direct-current (DC) voltage, alternating current (AC) voltage, or superimposed voltage including both.

The sheet feeder 11 includes a sheet tray 15 to contain sheets P and a feed roller 16 to transport the sheets P. Downstream from the feed roller 16 in a direction in which the sheet P is transported, a pair of registration rollers 17 is provided as timing rollers to transport the sheet P timely to the transfer nip. It is to be noted that "recording media" used there include, in addition to standard copy paper, heavy paper, post cards, thin paper such as tracing paper, coated paper, art paper, and special purpose sheets. Additionally, overhead projector (OHP) sheets or films may be used as the recording media.

The fixing device 12 includes a fixing roller 18 serving as a fixing member and a pressure roller 19 serving as a pressure member. The fixing roller 18 is heated by a heat source such as a heater. The pressure roller 19 is pressed against the fixing roller 18, and the contact portion therebetween serves as a fixing nip.

The discharge device 13 includes a pair of discharge rollers 20. An upper face of the apparatus body 100 is partly recessed into a discharge tray 21, and the sheet P discharged by the discharge rollers 20 is stacked on the discharge tray 21.

Referring to FIG. 1, image forming operation according to the present embodiment is described below.

When image formation is started, the photoreceptor 2 is rotated, and the charging roller 3 uniformly charges the surface of the photoreceptor 2 to a predetermined polarity. Then, the LED head array 6 directs a laser beam onto the charged surface of the photoreceptor 2 according to, for example, image data captured by a reading unit or transmitted from computers. Thus, an electrostatic latent image is formed on the photoreceptor 2. The electrostatic latent image on the photoreceptor 2 is developed into a toner image with toner supplied by the developing device 4.

Additionally, when image formation is started, the feed roller 16 rotates, thereby transporting the sheet P from the sheet tray 15. Then, the registration rollers 17 stop the sheet P temporarily and resume rotation at a predetermined timing to transport the sheet P to the transfer nip, timed to coincide with the arrival of the toner image on the photoreceptor 2.

At that time, a transfer bias voltage whose polarity is opposite a toner charge polarity of the toner image on the photoreceptor 2 is applied to the transfer roller 14, and thus a transfer electrical field is generated in the transfer nip. The transfer electrical field transfers the toner image from the photoreceptor 2 onto the sheet P (i.e., a transfer process). After the transfer process, the cleaning blade 5 removes toner remaining on the photoreceptor 2, and the removed toner is collected in the waste-toner chamber 9 of the toner cartridge 7.

The sheet P carrying the toner image is transported to the fixing device 12, and the toner image is fixed thereon with heat and pressure while the sheet P passes through the fixing nip between the fixing roller 18 and the pressure roller 19. Then, the pair of discharge rollers 20 discharges the sheet P onto the discharge tray 21.

Figure 2:
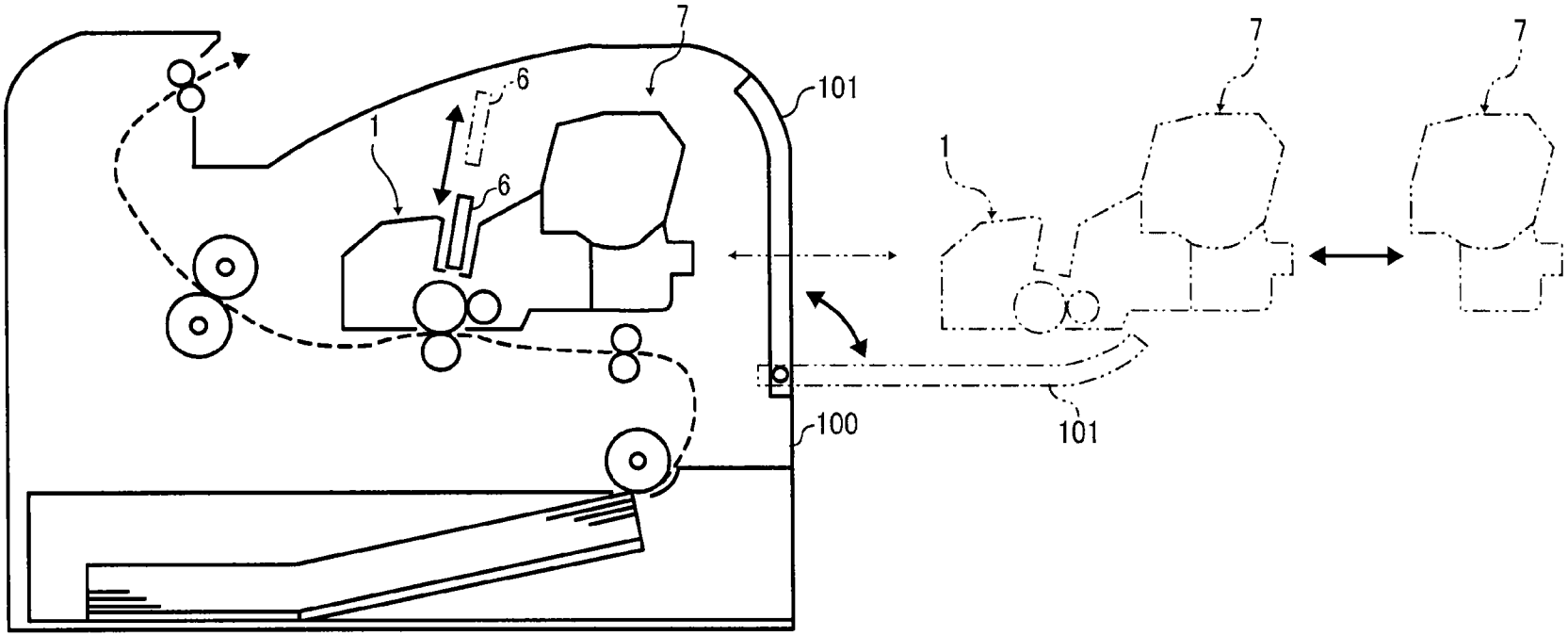
FIG. 2 illustrates installation and removal of a process unit in and from the image forming apparatus shown in FIG. 1.

Referring to FIG. 2, installation and removal of the process unit 1 is described below.

In the configuration shown in FIG. 2, an openable and closable cover 101 is provided on a rear side of the apparatus body 100. In a state in which the cover 101 is open, the LED head array 6 is lifted via a link assembly. With this configuration, when the cover 101 is open, the process unit 1 can be removed from the rear side while avoiding interference with the LED head array 6. Additionally, in the present embodiment, the process unit 1 and the toner cartridge 7 attached thereto can be removed together at a time. Additionally, the toner cartridge 7 can be attached to the process unit 1 and removed therefrom in both states in which the process unit 1 is installed in the apparatus body 100 and removed therefrom.

Figure 3:
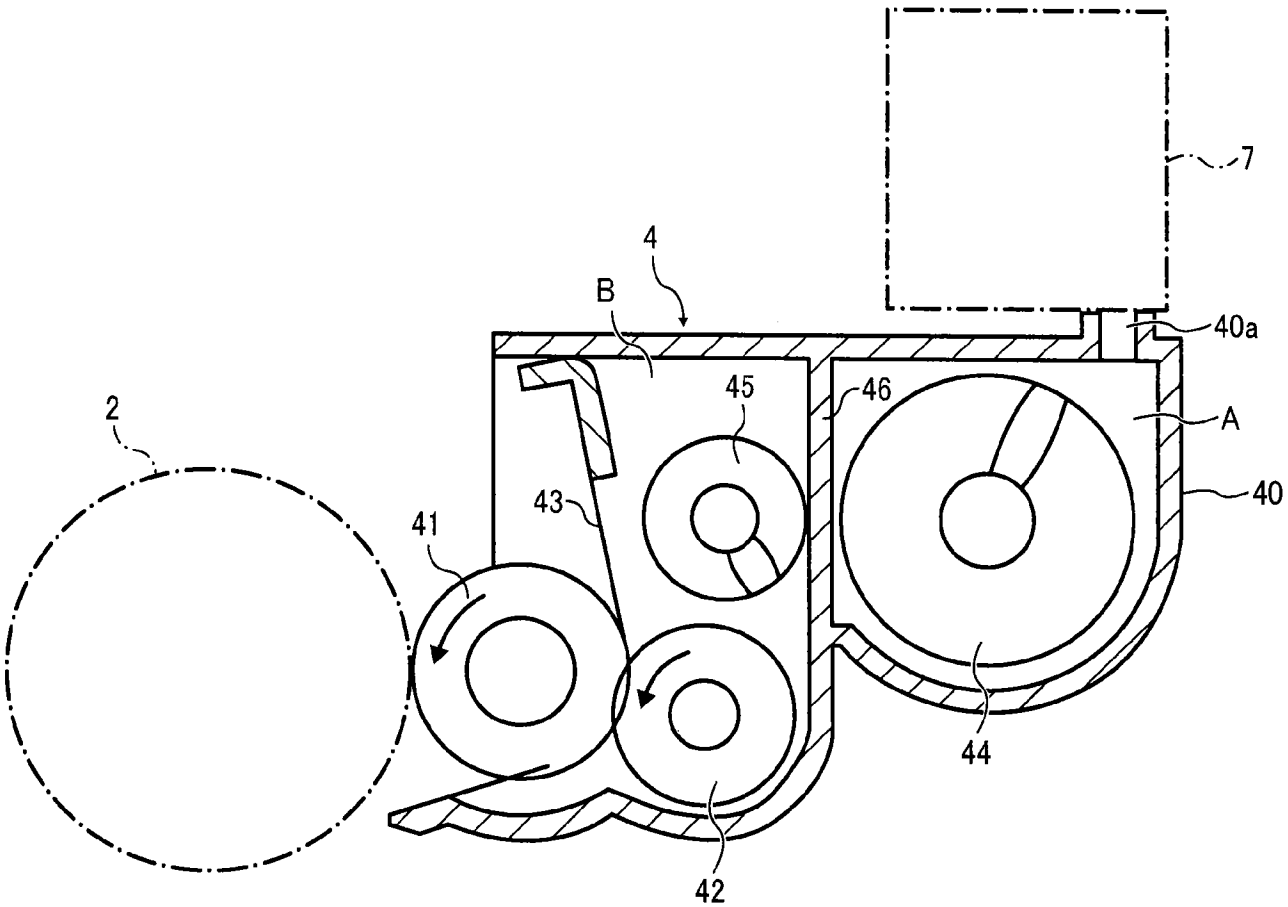
FIG. 3 is a schematic cross-sectional view illustrating a configuration of a developing device according to an embodiment.

FIG. 3 is a schematic cross-sectional view of the developing device 4.

As shown in FIG. 3, the developing device 4 according to the present embodiment includes a development housing 40 serving as a developer container to contain toner (i.e., developer), a developing roller 41 serving as a developer bearer, a supply roller 42 serving as a developer supply member to supply toner to the developing roller 41, a doctor blade 43 serving as a developer regulator to adjust the amount of toner carried on the developing roller 41, and first and second developer conveyance members 44 and 45 to transport toner.

The developing roller 41 rotates counterclockwise in FIG. 3 as indicated an arrow shown in FIG. 3 and transports toner carried thereon to a position facing the doctor blade 43 and a position facing the photoreceptor 2.

Additionally, the supply roller 42 is in contact with the developing roller 41 and supplies toner in the development housing 40 to an outer layer of the developing roller 41 by rotating in a direction (counterclockwise in FIG. 3) counter to the direction of rotation of the developing roller 41. It is to be noted that, in the present embodiment, the ratio of rotational frequency of the supply roller 42 to that of the developing roller 41 is 1 so that toner can be supplied reliably.

An end of the doctor blade 43 is in contact with the surface of the developing roller 41. When toner passes through a nip between the doctor blade 43 and the developing roller 41 (i.e., a regulation nip), the amount (layer thickness) of toner supplied by the supply roller 42 onto the developing roller 41 is adjusted, and the toner is frictionally charged simultaneously.

Additionally, the toner cartridge 7 serving as a developer container is provided above the development housing 40 and removably attached thereto. The developing device 4 and the toner cartridge 7 may be integrated into a single unit.

A toner inlet 40*a* (i.e., a supply inlet) is formed in an upper portion of the development housing 40 to supply toner from the toner cartridge 7 to the development housing 40.

Toner is supplied to the development housing 40 according to detection results by a developer amount detector 50 to be described later, configured to detect the amount of toner remaining in the development housing 40. More specifically, when the developer amount detector 50 detects that the amount of toner inside the development housing 40 is blow a predetermined amount, the toner cartridge 7 is driven a predetermined period of time, thereby supplying a predetermined amount of toner to the development housing 40.

Additionally, a partition 46 extending substantially parallel to an axial direction of the developing roller 41 divides, but not completely, the development housing 40 into a first compartment A in which the toner inlet 40*a* is positioned and a second compartment B in which the developing roller 41, the doctor blade 43, and the like are provided. In the present embodiment, the partition 46 stands vertically or substantially vertically, and the first and second compartments A and B are arranged horizontally or substantially horizontally. The first and second developer conveyance members 44 and 45 are positioned in the first and second compartments A and B, respectively.

Figure 4:
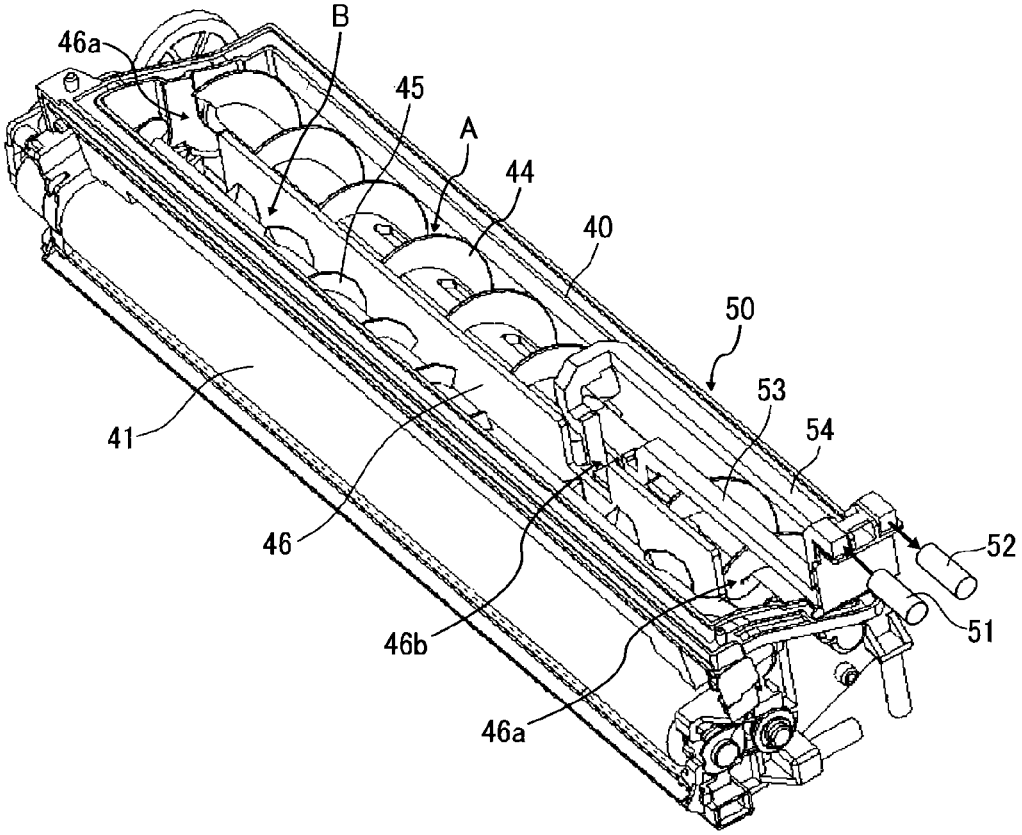
FIG. 4 is a perspective view of the developing device shown in FIG. 3, with a top side of a development housing removed.

As shown in FIG. 4, the first and second developer conveyance members 44 and 45 are positioned substantially facing each other via the partition 46 dividing the first compartment A and the second compartment B from each other. The partition 46 is shorter than the developing roller 41 in the axial direction of the developing roller 41. At both ends of the partition 46, main communication openings 46*a* are provided, and a sub-communication opening 46*b* is provided in an intermediate portion of the partition 46 between the main communication openings 46*a*. The first compartment A and the second compartment B can communicate with each other via the main communication openings 46*a* and the sub-communication opening 46*b*. The first and second developer conveyance members 44 and 45 transport toner axially by rotation.

The developer amount detector 50 is provided in the first compartment A to detect an area (i.e., a detection area) adjacent to the sub-communication opening 46*b* in the partition 46.

The developer amount detector 50 includes a light-emitting element 51, a light-receiving element 52, and first and second light guides 53 and 54. The light-emitting element 51 and the light-receiving element 52 together constitute an optical element. The first and second light guides 53 and 54 are provided to the development housing 40. For example, the light-emitting element 51 and the light-receiving element 52 are disposed outside the development housing 40 and attached to the apparatus body 100. For example, the first and second light guides 53 and 54 can be constructed of a material, such as an acrylic material and polycarbonate, that excels in light permeability or optical fiber.

In the present embodiment, each of the first and second light guides 53 and 54 is introduced into the first compartment A from above. A first end of the first light guide 53 is exposed outside the development housing 40 and is positioned to face the light-emitting element 51. By contrast, a second end of the first light guide 53 is positioned in the first compartment A inside the development housing 40. Additionally, a first end of the second light guide 54 is positioned in the first compartment A and at a predetermined distance from the second end of the first light guide 53 in a longitudinal direction of the partition 46. By contrast, a second end of the second light guide 54 is exposed from the development housing 40 and is positioned to face the light-receiving element 52.

The light emitted from the light-emitting element 51 enters the first end of the first light guide 53 and exits from the second end of the first light guide 53. The light exiting the first light guide 53 enters the second light guide 54 from the first end thereof and exits from the second end of the second light guide 54. Then, the light reaches the light-receiving element 52. Thus, the second end of the first light guide 53 and the first end of the second light guide 54 facing each other defines a light transmission path L (i.e., a gap) therebetween.

When the amount of toner in the development housing 40 is sufficient, light is blocked by the toner present in the gap between the second end of the first light guide 53 and the first end of the second light guide 54 facing each other. Thus, the light-receiving element 52 does not receive the light. However, as toner is consumed in printing, the level of toner in the development housing 40 descends below the first and second light guides 53 and 54, that is, no toner is present between the second end of the first light guide 53 and the first end of the second light guide 54. Accordingly, the light reaches the light-receiving element 52. Thus, the amount of toner inside the development housing 40 can be detected according to changes in the output value of the light-receiving element 52. Specifically, for example, when the amount of toner is recognizable, a reference waveform obtained with the light-receiving element 52 is stored in a memory of a controller of the apparatus, and a measured waveform in the detection is compared with the reference waveform, thereby determining the amount of toner. In the present embodiment, the light transmission path L (indicated with hatching in FIG. 7) between the first light guide 53 and the second light guide 54 functions as the detection area for toner amount detection.

The first and second developer conveyance members 44 and 45 rotate to transport toner in opposite directions as indicated by arrows X shown in the drawings. The toner transported by the first and second developer conveyance members 44 and 45 to axial ends of the first and second compartments A and B is not transported further in the axial direction but is transported through the main communication openings 46*a* to the other compartment (from the first compartment A to the second compartment B, or from the second compartment B to the first compartment A). Then, toner is transported by the first and second developer conveyance members 44 and 45 in the first and second compartments A and B to the opposite ends, respectively, after which toner is transported again through the main communication openings 46*a* to the other compartment. Toner can be circulated between the first compartment A and the second compartment B by repeating this operation. The first and second compartments A and B together constitute a toner conveyance route.

Figure 6:
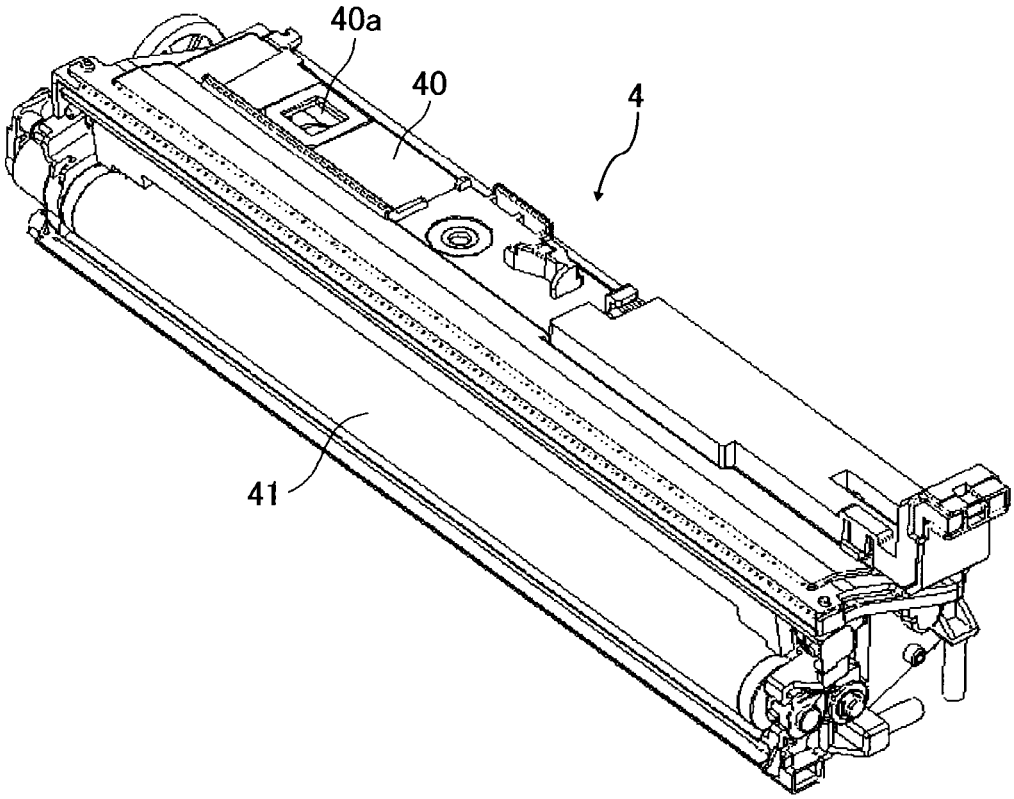
FIG. 6 is a perspective view of the developing device shown in FIG. 3, with the top side closed.

To mix the supplied toner with the toner inside the development housing 40 sufficiently, it is preferable that the distance from the toner inlet 40*a* to the second compartment B, which corresponds to the development range, be relatively long so that the supplied toner is mixed in for a longer time. Accordingly, as the location of the toner inlet 40*a*, the first compartment A is more preferable than the second compartment B. More preferably, the toner inlet 40*a* is positioned on the upstream side in the first compartment A in a developer conveyance direction as shown in FIG. 6.

Additionally, while toner is circulated as described above, toner flows from the second compartment B through the sub-communication opening 46*b* into the light transmission path L (shown in FIG. 7) in the first compartment A as indicated by arrow Y. With this configuration, even when toner aggregates and remains adjacent to the light transmission path L in the first compartment A, the remaining toner is moved by the toner flowing from the second compartment B to the light transmission path L. In a state in which the developing device 4 is installed in the image forming apparatus 200, the sub-communication opening 46*b* is positioned in the intermediate portion of the partition 46 and at a position overlapping with the developing roller 41 when viewed in a horizontal direction perpendicular to the axial direction of the developing roller 41.

Accordingly, when toner flows from the sub-communication opening 46*b* thereto, the toner in the light transmission path L of the first compartment A can be kept to a level reflecting the amount of toner inside the second compartment B and adjacent to the developing roller 41. This configuration can reduce erroneous detection of the amount of toner in the light transmission path L, and accuracy of toner amount detection can improve. This configuration is advantageous particularly in compact developing devices. Toner is more likely to aggregate when the developing device 4 becomes compact and accordingly the toner conveyance route inside the development housing 40 is reduced in size. With the sub-communication opening 46*b*, however, a desirable flow of toner can be maintained around the light transmission path L.

Figure 7:
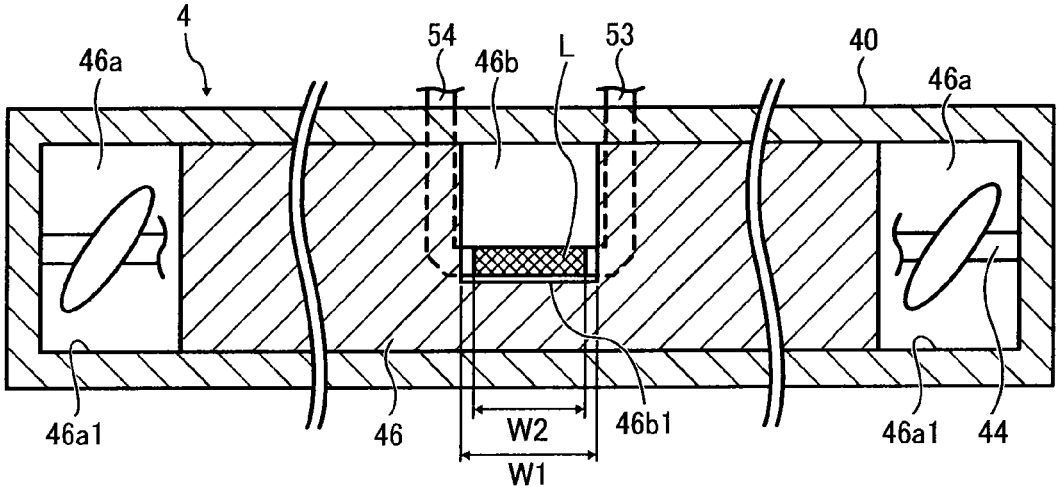
FIG. 7 is a schematic cross-sectional view along line A-A shown in FIG. 5.

Additionally, as shown in FIG. 7, in the present embodiment, since the developing device 4 is relatively compact and the internal space thereof is limited, each of the first and second light guides 53 and 54 is introduced into the first compartment A from above.

Consequently, in the first compartment A, the first and second light guides 53 and 54 hinder toner from flowing into the light transmission path L from above on the upstream side in the developer conveyance direction. Accordingly, the flow of toner through the sub-communication opening 46*b* into the light transmission path L is particularly effective. In other words, with the sub-communication opening 46*b*, both of compactness of the developing device 4 and higher accuracy in toner amount detection can be secured.

Additionally, as shown in FIG. 7, an opening area of the sub-communication opening 46*b* is smaller than that of each of the main communication openings 46*a*. With this configuration, toner is more likely to flow through the main communication openings 46*a* than the sub-communication opening 46*b*. Accordingly, this configuration can cause toner to flow to the light transmission path L without adversely affecting the circulation of toner via the main communication openings 46*a*.

In the axial direction of the developing roller 41, a length W1 (i.e., a width) of the sub-communication opening 46*b* is greater than a length W2 of the light transmission path L. With this configuration, since toner flows in a greater range than a range of the light transmission path L, the inflow of toner into the light transmission path L can be secured.

A lower end 46*b*1 of the sub-communication opening 46*b* is positioned higher than a lower end 46*a*1 the main communication opening 46*a*. With this arrangement, toner can flow in the sub-communication opening 46*b* only when the amount of toner exceeds a predetermined amount. Accordingly, when the amount of toner is smaller than the predetermined amount, toner circulates through only the main communication openings 46*a* without flowing in the sub-communication opening 46*b*. It is to be noted that the amount of toner at which toner starts flowing in the sub-communication opening 46*b* can be adjusted with the height of the lower end 46*b*1 of the sub-communication opening 46*b*.

Figure 8:
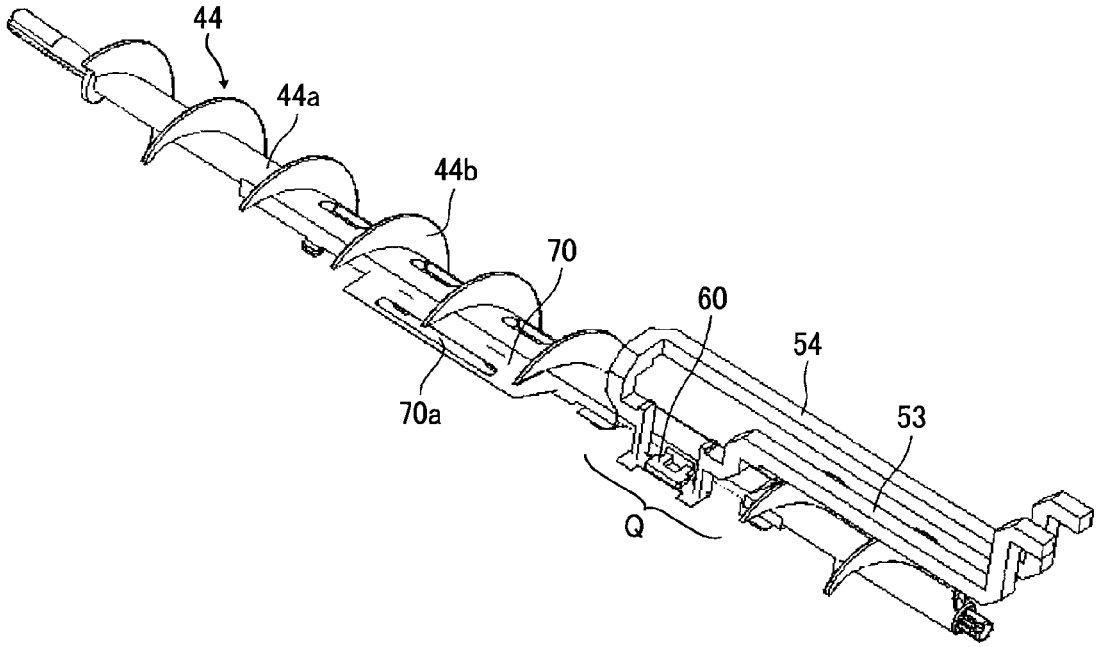
FIG. 8 is a perspective view illustrating relative positions of a first developer conveyance member and light guides.
Figure 9:
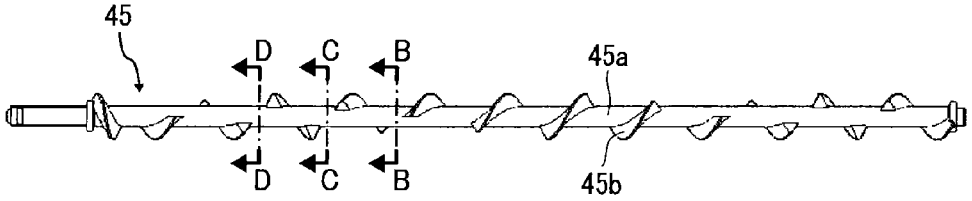
FIG. 9 is a side view of a second developer conveyance member.

As shown in FIG. 8, the first developer conveyance member 44 can be a screw including a rotary shaft 44*a* and a conveyance blade 44*b* spirally provided to the outer circumference of the rotary shaft 44*a*.

Figure 5:
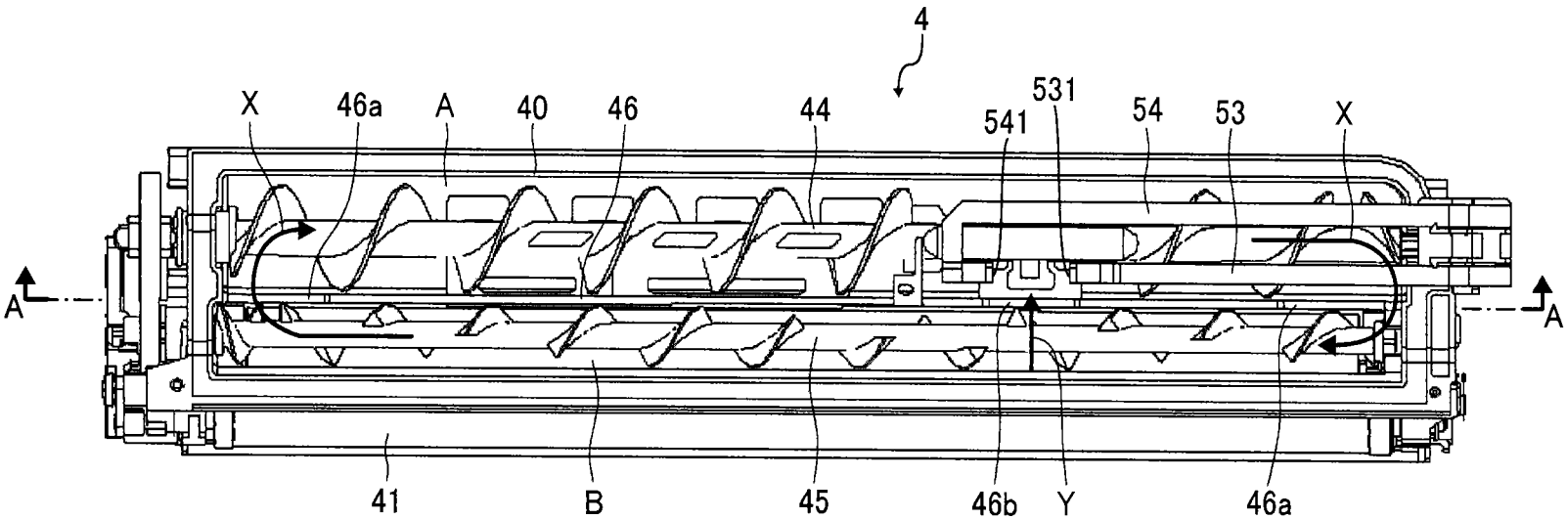
FIG. 5 is a plan view of the developing device shown in FIG. 3, with the top side of the development housing removed.

A cleaner 60 is provided to the rotary shaft 44*a* of the first developer conveyance member 44 to clean the ends (in particular, end faces 531 and 541 shown in FIG. 5) of the first and second light guides 53 and 54 facing each other. The cleaner 60 is a flexible member and may be constructed of, for example, a polyethylene terephthalate (PET) sheet. A length of the cleaner 60 in the axial direction of the first developer conveyance member 44 is slightly longer than the gap between the end face 531 of the first light guide 53 and the end face 541 of the second light guide 54 facing it. With this configuration, as the first developer conveyance member 44 rotates, the cleaner 60 contacts both the end face 531 of the first light guide 53 and the end face 541 of the second light guide 54, scraping off toner adhering thereto. This configuration can maintain reliable transmission of light from the first light guide 53 to the second light guide 54. It is to be noted that the cleaner 60 is not oblique to the rotary shaft 44*a* and is not capable of transporting developer axially, differently from the conveyance blade 44*b*. The cleaner 60 is configured to contact at least one of the end faces 531 and 541 of the first and second light guides 53 and 54. The cleaner 60 may be omitted.

Additionally, in the axial direction, the first developer conveyance member 44 includes a partial range Q where the conveyance blade 44*b* is not present, and the ends of the first and second light guides 53 and 54 facing each other are disposed within the partial range Q. This arrangement can prevent the first and second light guides 53 and 54 from interfering with the conveyance blade 44*b*, and the light transmission path L (shown in FIG. 7) between the first and second light guides 53 and 54 can be positioned within the orbit of rotation of the conveyance blade 44*b*. In other words, the light transmission path L between the first and second light guides 53 and 54 is positioned inside the outer circumference of the conveyance blade 44*b* when viewed in the axial direction of the rotary shaft 44*a*.

It is to be noted that, although the entire light transmission path L is within the orbit of rotation in the present embodiment, alternatively, the light transmission path L may be positioned, partly or entirely, outside the orbit of rotation of the conveyance blade 44*b*. Additionally, the light transmission path L between the first and second light guides 53 and 54 substantially parallels the direction in which the first developer conveyance member 44 transports developer, that is, the axis of the first developer conveyance member 44. It is to be noted that, alternatively, the light transmission path L may be in a direction crossing (for example, perpendicular to) the axial direction of the first developer conveyance member 44.

As shown in FIG. 8, the first developer conveyance member 44 is further provided with a flexible agitation blade 70 to agitate toner. The agitation blade 70 is attached to the rotary shaft 44*a* upstream from the cleaner 60 in the toner conveyance direction. Additionally, the agitation blade 70 extends from the rotary shaft 44*a* beyond the outer circumference of the conveyance blade 44*b*, and an edge of the agitation blade 70 draws an orbit outside the orbit of rotation of the conveyance blade 44*b*. The agitation blade 70 is constructed of a flexible member such as polyethylene terephthalate (PET) sheet and integrated with the cleaner 60 in the present embodiment. Needless to say, the agitation blade 70 may be separate from the cleaner 60. With the agitation blade 70, mixing of the supplied toner with the toner existing in the development housing 40 can be promoted. It is to be noted that the agitation blade 70 is not oblique to the rotary shaft 44*a* and is not capable of transporting toner axially differently from the conveyance blade 44*b*.

Additionally, as in the configuration shown in FIG. 8, an opening 70*a* (such as a slit) to let toner to pass through may be provided to the agitation blade 70 to alleviate the stress on the agitation blade 70 given by the toner when the agitation blade 70 rotates. For a similar purpose, one or multiple slits may be cut in the agitation blade 70 to divide the agitation blade 70 into multiple segments. The agitation blade 70 may be omitted.

Figure 10A:
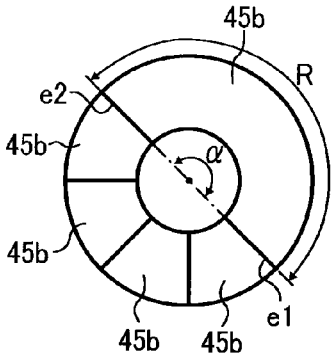
FIGS. 10A, 10B, and 10C are cross-sectional views of the second developer conveyance member respectively along line B-B, line C-C, and line D-D shown in FIG. 9.
Figure 10B:
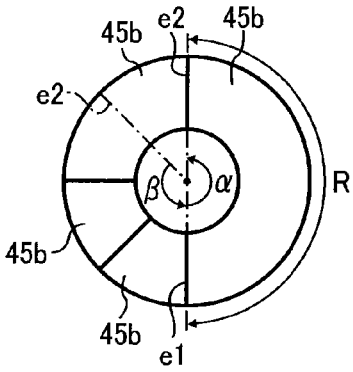
Figure 10C:
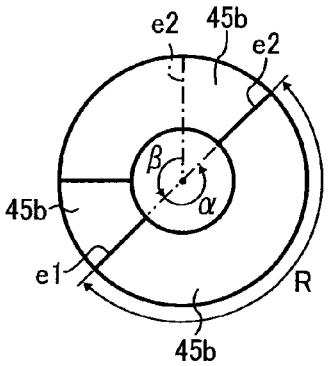

By contrast, although the second developer conveyance member 45 is a screw including a rotary shaft 45*a* and a spiral blade spirally provided to the outer circumference of the rotary shaft 45*a*, the spiral blade is discontinuous in the axial direction and constructed of multiple conveyance blades 45*b*. As shown in FIGS. 10A, 10B, and 10C, when viewed in the axial direction of the second developer conveyance member 45, ranges R of the two conveyance blades 45*b* axially adjacent are shifted in a circumferential direction (in a shape of arc) of the second developer conveyance member 45. That is, in the spiral range of the conveyance blades 45*b* provided to the outer circumference of the rotary shaft 45*a*, there are ranges where the conveyance blade 45*b* is absent, thereby dividing the spiral blade into the multiple conveyance blades 45*b*, and the two conveyance blades 45*b* axially adjacent are disposed in the ranges R shifted from each other in the circumferential direction. In this configuration, toner conveyance speed can be slowed compared with a configuration in which the spiral blade is continuous in the axial direction. Additionally, since the ranges R where the respective conveyance blades 45*b* are provided are shifted in the circumferential direction, the conveyance blades 45*b* can give toner conveyance force consecutively and transport toner reliably.

Specifically, as shown in FIGS. 10A through 10C, when the size of the ranges R where the conveyance blades 45*b* are provided are defined in the term of a central angle $\alpha$, the central angle $\alpha$ of the ranges R is preferably within a range from about 180 degrees to 315 degrees and adjusted depending on the fluidity of toner used. For example, the central angle $\alpha$ is 180 degrees in the present embodiment. Additionally, as shown in these drawings, when the amount of shift between the ranges R of the conveyance blades 45*b* axially adjacent (i.e., upstream and downstream conveyance blades 45*b* in the developer conveyance direction) is defined as a difference $\beta$ between an end edge e2 of the upstream conveyance blade 45*b* and a start edge e1 of the downstream conveyance blade 45*b*, the difference $\beta$ is preferably within a range from 45 degrees to 180 degrees and adjusted depending on the fluidity of toner used. For example, the difference $\beta$ is 135 degrees in the present embodiment.

It is to be noted that, in the present embodiment, when the second developer conveyance member 45 is viewed in the axial direction, the two ranges R of the conveyance blades 45*b* axially adjacent overlap partly in the circumferential direction, thus eliminating circumferential ranges where only the ranges without the conveyance blades 45*b* overlap each other. It is preferable that the ranges R where the conveyance blades 45*b* are provided be identical or similar in size and shifted by an identical or similar amount in the circumferential direction.

The above-described configuration of the second developer conveyance member 45 is advantageous as follows. Due to the demand for more compact image forming apparatuses, gears to give rotational driving force to the developer conveyance members continue to shrink. In this case, it is possible that the velocity of rotation of the developer conveyance member increases and the toner conveyance speed is accelerated extremely. Accordingly, it is preferred to adjust the toner conveyance speed using a configuration different from a drive transmission system such as the gears for reliable toner conveyance. In view of the foregoing, the conveyance blades 45*b* are configured as described above in the present embodiment. Thus, the toner conveyance speed can be adjusted without modifying the drive transmission system. It is to be noted that this configuration may be used also in the first developer conveyance member 44 provided in the first compartment A not limited to the second developer conveyance member 45 provided in the second compartment B.

As described above, according to the embodiment described above, with the effects of toner flowing through the sub-communication opening 46*b* in the partition 46, the amount of toner in the first compartment A (the light transmission path L in particular) can be kept to a desirable level reflecting the amount of toner adjacent to the developing roller 41 and inside the second compartment B. Accordingly, erroneous detection of the amount of toner can be reduced, and accuracy of toner amount detection can improve.

Numerous additional modifications to the above-described embodiment and variations are possible. It is therefore to be understood that, within the scope of the appended claims, the disclosure of this patent specification may be practiced otherwise than as specifically described herein.

For example, although the description above concerns the configuration in which the first and second compartments A and B are horizontally adjacent via the partition 46, alternatively, the first and second compartments A and B may be vertically adjacent to each other via the partition 46. In this case, the first compartment A is above the second compartment B.

Additionally, although a sensor to detect transmitted light is used as the developer amount detector 50 in the above-described embodiment, alternatively, a sensor to detect reflected light, a magnetic permeability sensor, or the like may be used instead. Additionally, although one-component developer consisting essentially toner is used in the above-described embodiment, two-component developer including toner and carrier may be used instead.

Additionally, although the toner cartridge 7 is removably installed in the amount of the process unit 1 in the above-described embodiment, alternatively, the toner cartridge 7 may be removably installed in a mount of the apparatus body 100 directly.

Figure 11:
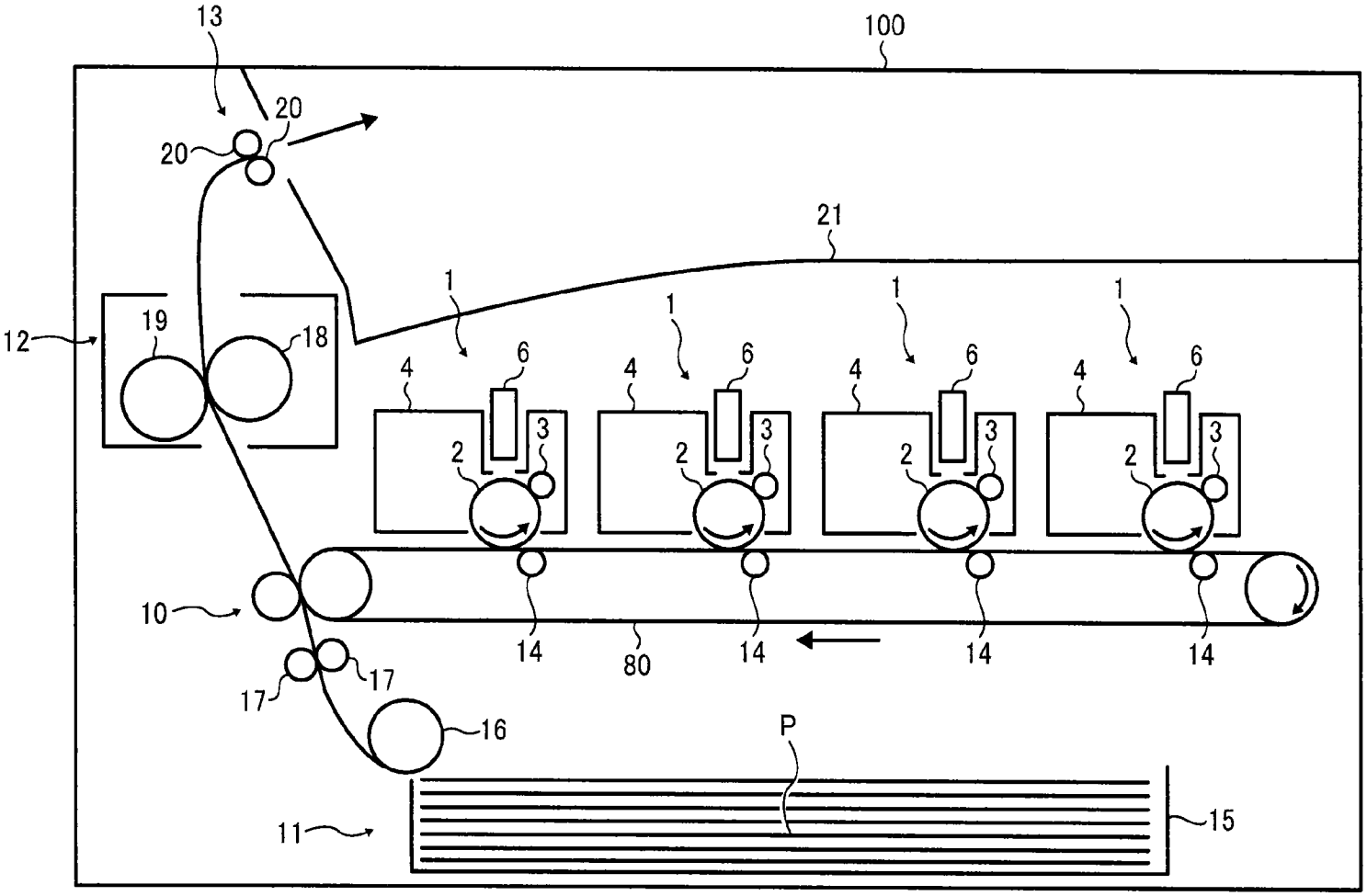
FIG. 11 is a schematic view illustrating a configuration of a multicolor image forming apparatus employing an intermediate transfer method, according to another embodiment.
Figure 12:
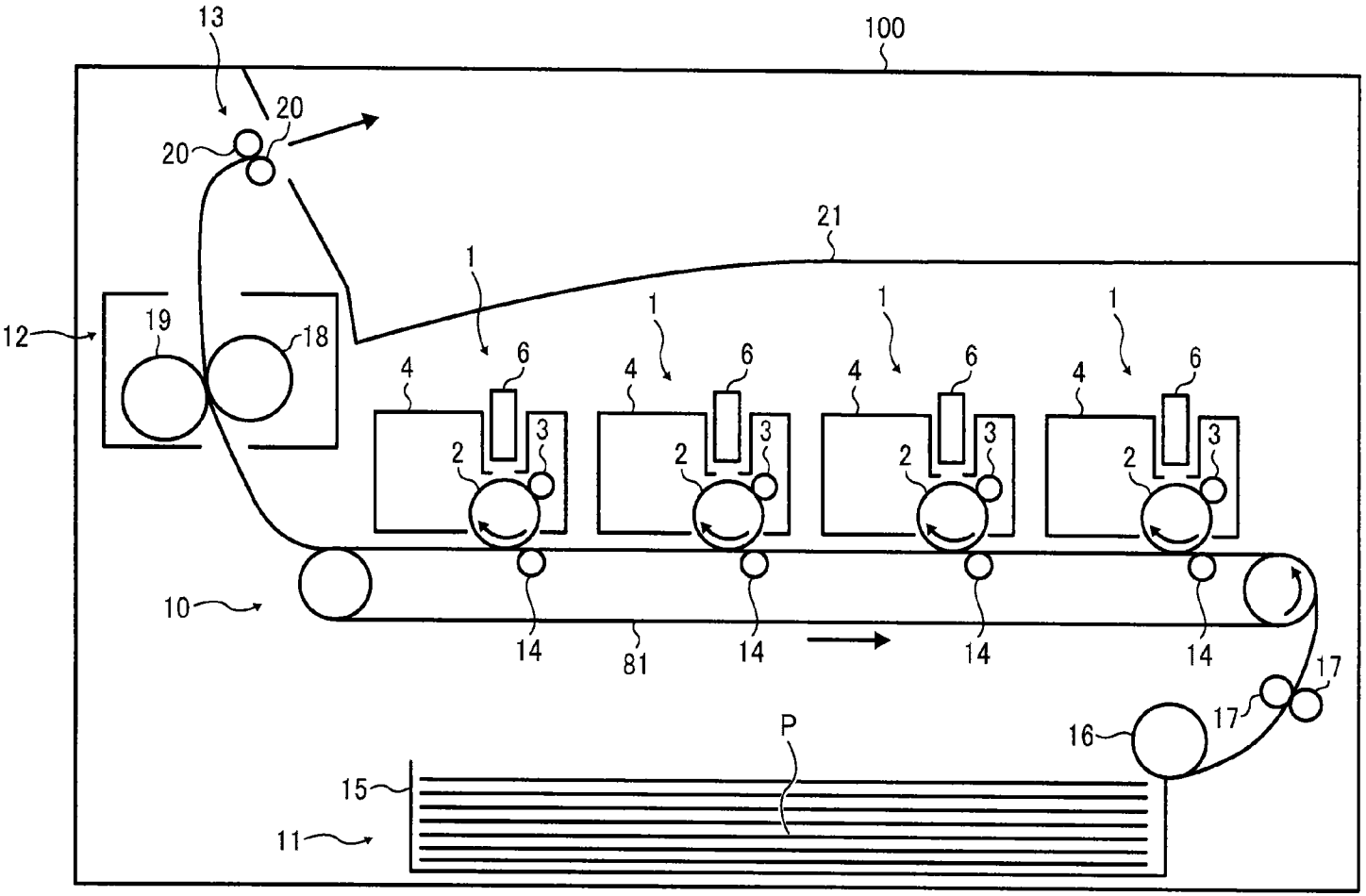
FIG. 12 is a schematic view illustrating a configuration of a multicolor image forming apparatus employing a direct transfer method, according to another embodiment.

Additionally, although the monochrome image forming apparatus 200 is described above, various aspects of this specification can adapt to image forming apparatuses of other types, such as a multicolor image forming apparatus employing an intermediate-transfer method shown in FIG. 11 and a multicolor image forming apparatus employing a direct-transfer method shown in FIG. 12, for example.

The image forming apparatus shown in FIG. 11 indirectly transfers images formed on multiple photoreceptors 2 via an intermediate transfer belt 80 (an intermediate transfer member) onto a sheet P. The image forming apparatus shown in FIG. 12 transfers images formed on multiple photoreceptors 2 directly onto a sheet P transported by a conveyance belt 81 (a conveyor).

It is to be noted that elements of the image forming apparatuses shown in FIGS. 11 and 12 similar to those of the image forming apparatus 200 shown in FIG. 1 are given identical reference numerals, and the descriptions thereof are omitted.

Yet additionally, various aspects of this specification are applicable to printers, copiers, facsimile machines, and multifunction machines or multifunction peripherals (MFPs) having these capabilities.

What is claimed is:

1. A developing device comprising:

a developer container to contain developer;

a developer bearer to bear developer on a surface thereof;

a partition to divide an interior of the developer container into a first compartment to which developer is supplied and a second compartment in which the developer bearer is disposed;

main communication openings provided at both ends of the partition, the main communication openings through which the first compartment and the second compartment communicate with each other;

a sub-communication opening provided in an intermediate portion of the partition, the sub-communication opening through which the first compartment and the second compartment communicate with each other;

developer conveyance members respectively provided in the first compartment and the second compartment to circulate by rotation developer therebetween; and a developer amount detector to detect an amount of developer in a detection area positioned in the first compartment, the detection area adjacent to the sub-communication opening, wherein the developer amount detector includes:

a light-emitting element to emit light;

a light-receiving element to receive the light;

a first light guide including an end face disposed inside the first compartment to guide the light emitted from the light-emitting element into the first compartment; and a second light guide to guide the light guided to the first compartment to the light-receiving element, the second light guide including an end face disposed inside the first compartment across a light transmission path from the end face of the first light guide.

2. The developing device according to claim 1, wherein, in a state in which the developing device is installed in an image forming apparatus, the sub-communication opening is position to overlap with the developer bearer when viewed in a horizontal direction perpendicular to an axial direction of the developer bearer.

3. The developing device according to claim 1, wherein an opening area of the sub-communication opening is smaller than an opening area of the main communication opening.

4. The developing device according to claim 1, wherein the sub-communication opening is longer than the detection area in a longitudinal direction of the partition.

5. The developing device according to claim 4, wherein the partition stands vertically, the first compartment and the second compartment are horizontally adjacent to each other, and a lower end of the sub-communication opening is positioned higher than a lower end of the main communication opening.

6. The developing device according to claim 1, wherein the detection area is constructed of the light transmission path between the first light guide and the second light guide, and the light transmission path extends along a longitudinal direction of the partition.

7. The developing device according to claim 6, wherein the first light guide and the second light guide are introduced into the first compartment from above the developer container.

8. The developing device according to claim 6, further comprising a cleaner to clean at least one of the end face of the first light guide and the end face of the second light guide facing each other via the light transmission path, wherein the developer conveyance member includes a rotary shaft, and the cleaner is provided to the rotary shaft of the developer conveyance member.

9. A process unit removably installable in an image forming apparatus, the process unit comprising an image bearer to bear a latent image; and the developing device according to claim 1, to develop the latent image.

10. An image forming apparatus comprising the process unit according to claim 9.

11. The developing device according to claim 6, further comprising an agitation blade attached to the rotary shaft upstream from the cleaner in a toner conveyance direction.

12. A developing device comprising:

a developer container to contain developer;

a developer bearer to bear developer on a surface thereof;

a partition to divide an interior of the developer container into a first compartment to which developer is supplied and a second compartment in which the developer bearer is disposed;

main communication openings provided at both ends of the partition, the main communication openings through which the first compartment and the second compartment communicate with each other;

a sub-communication opening provided in an intermediate portion of the partition, the sub-communication opening through which the first compartment and the second compartment communicate with each other;

developer conveyance members respectively provided in the first compartment and the second compartment to circulate by rotation developer therebetween; and a developer amount detector to detect an amount of developer in a detection area positioned in the first compartment, the detection area adjacent to the sub-communication opening, wherein the developer amount detector includes a detecting portion to protrude into the first compartment, the detecting portion faces the sub-communication opening.

13. The developing device according to claim 12, wherein, in a state in which the developing device is installed in an image forming apparatus, the sub-communication opening is position to overlap with the developer bearer when viewed in a horizontal direction perpendicular to an axial direction of the developer bearer.

14. The developing device according to claim 12, wherein an opening area of the sub-communication opening is smaller than an opening area of the main communication opening.

15. The developing device according to claim 12, wherein the sub-communication opening is longer than the detection area in a longitudinal direction of the partition.

16. The developing device according to claim 15, wherein the partition stands vertically, the first compartment and the second compartment are horizontally adjacent to each other, and a lower end of the sub-communication opening is positioned higher than a lower end of the main communication opening.

17. The developing device according to claim 12, wherein the developer amount detector comprises:

a light-emitting element to emit light;

a light-receiving element to receive the light;

a first light guide including an end face disposed inside the first compartment to guide the light emitted from the light-emitting element into the first compartment; and a second light guide to guide the light guided to the first compartment to the light-receiving element, the second light guide including an end face disposed inside the first compartment across a light transmission path from the end face of the first light guide, wherein the detection area is constructed of the light transmission path between the first light guide and the second light guide, and the light transmission path extends along a longitudinal direction of the partition.

18. The developing device according to claim 17, wherein the first light guide and the second light guide are introduced into the first compartment from above the developer container.

19. The developing device according to claim 17, further comprising a cleaner to clean at least one of the end face of the first light guide and the end face of the second light guide facing each other via the light transmission path, wherein the developer conveyance member includes a rotary shaft, and the cleaner is provided to the rotary shaft of the developer conveyance member.

20. A process unit removably installable in an image forming apparatus, the process unit comprising an image bearer to bear a latent image; and the developing device according to claim 12, to develop the latent image.

* * * * *